US006176599B1

(12) United States Patent
Farzen

(10) Patent No.: US 6,176,599 B1
(45) Date of Patent: Jan. 23, 2001

(54) INSULATED CEILING TYPE LOW VOLTAGE RECESSED HOUSING

(76) Inventor: Fred Farzen, P.O. Box 82-144, Taipei (TW)

( * ) Notice: Under 35 U.S.C. 154(b), the term of this patent shall be extended for 0 days.

(21) Appl. No.: 09/398,433

(22) Filed: Sep. 17, 1999

(51) Int. Cl.[7] ..... F21S 8/02

(52) U.S. Cl. ..... 362/365; 362/362; 362/364; 362/145; 362/147; 362/148; 362/150

(58) Field of Search ..... 362/145, 147, 362/148, 150, 362, 364, 365, 373, 366

(56) References Cited

U.S. PATENT DOCUMENTS 5,440,471 * 8/1995 Zadeh ..... 362/365
5,597,234 * 1/1997 Winkelhake ..... 362/364
5,868,493 * 2/1999 Winkelhake ..... 362/439

* cited by examiner

*Primary Examiner*—Sandra O'Shea
*Assistant Examiner*—Ismael Negron
(74) *Attorney, Agent, or Firm*—A & J

(57) ABSTRACT

An insulated ceiling type low voltage recessed housing includes a rectangular plaster frame, an enclosure mounted on the plaster frame and having one side provided with a cylindrical frame, a housing fixedly fitted in the cylindrical frame, a junction box mounted on another side of the enclosure, and a transformer mounted on the junction box door, whereby the transformer can be easily removed from the recessed housing for maintenance.

2 Claims, 8 Drawing Sheets

INSULATED CEILING TYPE LOW VOLTAGE RECESSED HOUSING

BACKGROUND OF THE INVENTION

1. Field of the Invention

This invention is related to an improvement in the structure of an insulated ceiling type low voltage recessed housing. The improvement comprises a thermal insulation mounted on the top of the housing of recessed lighting fixture and mounted position of specially designed transformer which minimizes heat generation.

The thermal insulation on the top of the housing can reduce and/or eliminate the heat transfer from the housing to the enclosure on the plaster frame so that the enclosure does not require big space for circulation of air at the inside. This method can also reduce the distance between the housing and the transformer.

By placing the specially designed transformer which generates very low heat, the low heat from the transformer can be transferred to outside trough the junction box so that there is no excessive heat inside of the enclosure on the plaster frame and this method can reduce the size of the plaster frame and the size of the enclosure.

Also there is other advantage obtained from the mounting method for the transformer. The transformer is mounted on the junction box door by screws which can be easily removed at any time for replacement and/or maintenance.

The housing is assembled with removable screws on the plaster frame. After the screws are removed, the housing can be taken out from the plaster frame. In addition, the junction box door employing the transformer is assembled with junction box with clip mounted on the junction box frame. Therefore, the junction box door employing transformer can be easily removed from the junction box and can be taken out through the hole on the plaster frame for the housing. If the transformer is defected, it can be easily replaced with a new one after the mounting screws are removed from the defected transformer.

2. Description of the Prior Art

Conventional insulated ceiling type recessed light fixtures have a big plaster frame with a size of 14"×13.5" and a transformer mounted on the plaster frame. It is because the conventional insulated ceiling type recessed light fixtures requires large space inside of the enclosure on plaster frame to allow free circulation of air to prevent problems caused by heat energy generated by the low voltage lamp utilized in the recessed light fixture and by the transformer mounted on the plaster frame. Hence, installation of the conventional insulated ceiling type recessed lighting fixture is difficult due to the size of the plaster frame thereby causing increase of material and labor costs. In addition, since the transformer is fixedly mounted on the plaster frame, it is necessary to remove the recessed housing from the ceiling in order to dismantle the transformer from the plaster frame for maintenance thus causing cost increase and inconvenience in operation.

Therefore, it is an object of the present invention to provide an insulated ceiling type low voltage recessed housing which can obviate and mitigate the above-mentioned drawbacks.

SUMMARY OF THE INVENTION

This invention is related to an improvement in the structure of an insulated ceiling type low voltage recessed housing.

It is the primary object of the present invention to provide an improved insulated ceiling type low voltage recessed housing which can reduce the heat energy generated by the low voltage lamp and by the transformer.

It is another object of the present invention to provide an improved insulated ceiling type low voltage recessed housing which enables the transformer to be easily removed at any time for replacement and/or maintenance.

According to a preferred embodiment of the present invention, an insulated ceiling type low voltage recessed housing includes a rectangular plaster frame, an enclosure mounted on the plaster frame and having one side provided with a cylindrical frame, a housing fixedly fitted in the cylindrical frame, a junction box door mounted on another side of the enclosure, and a transformer mounted on the junction box door, whereby the transformer can be easily removed from the recessed housing for maintenance.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts. Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 1:
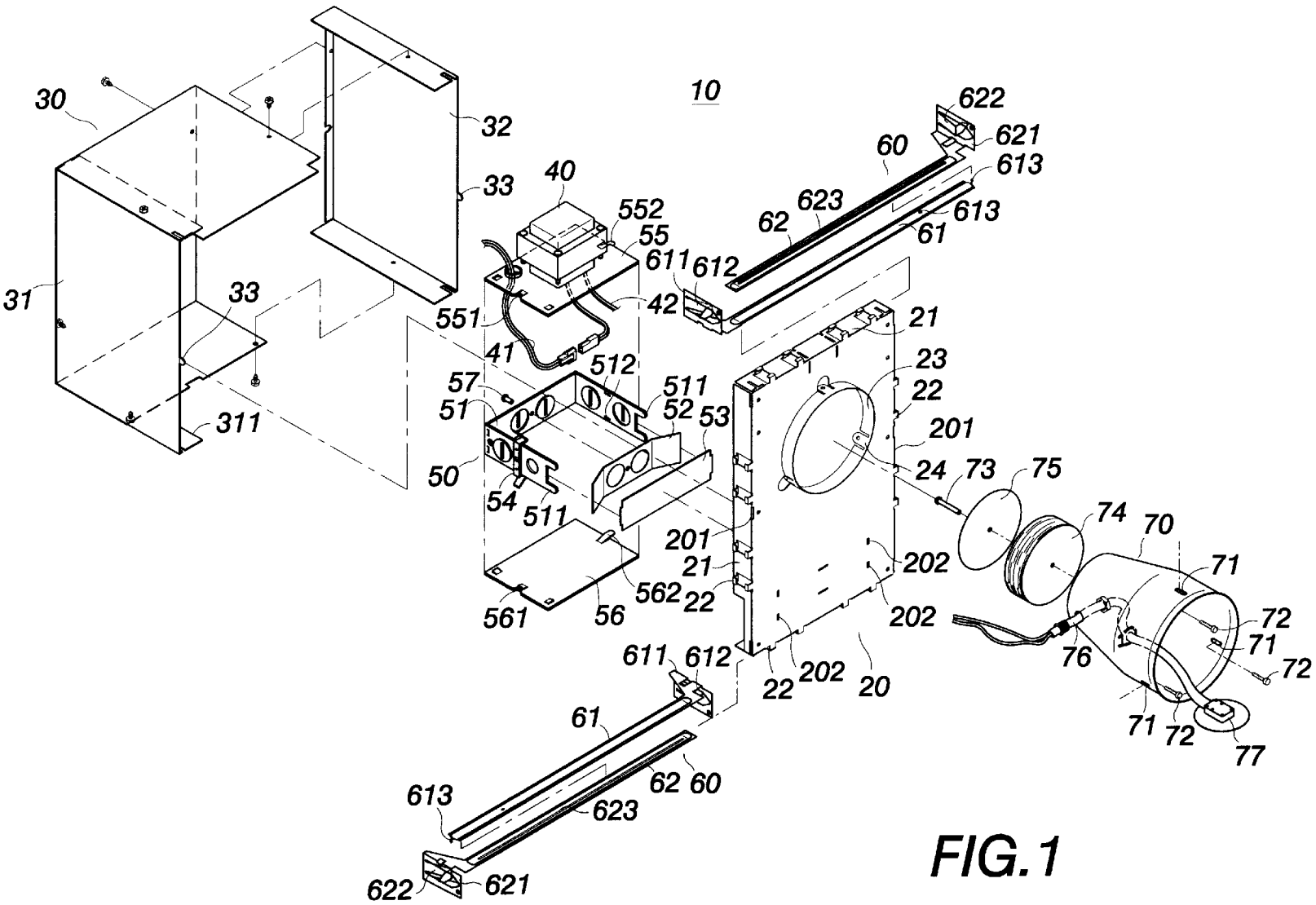
FIG. 1 is an exploded view of the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 2:
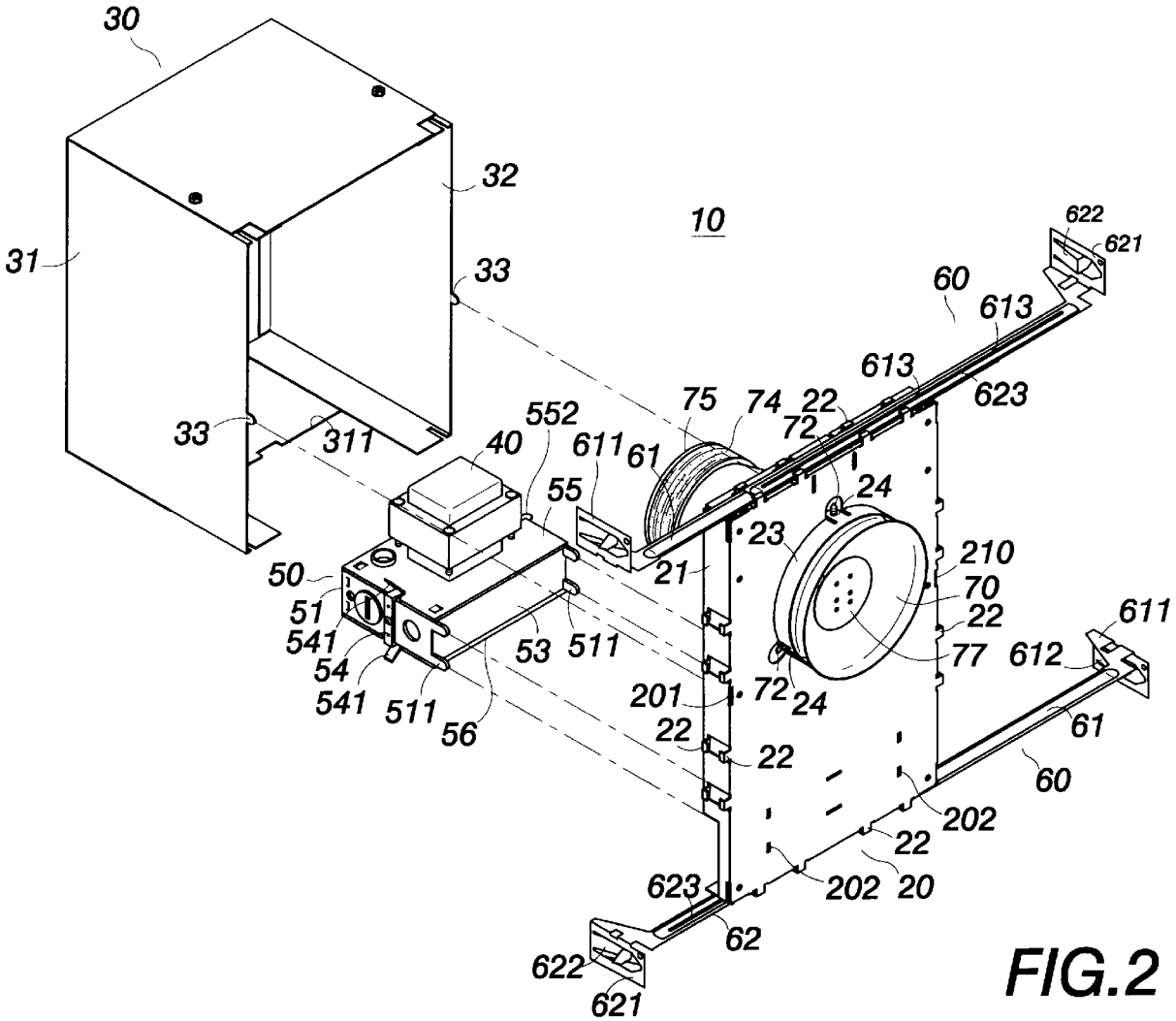
FIG. 2 is an another exploded view of the present invention.

With reference to the drawings and in particular to FIGS. 1 and 2 thereof, the insulated ceiling type low voltage recessed housing 10 according to the present invention generally comprises a plaster frame 20, an enclosure 30, a transformer 40, a junction box 50 for mounting the transformer 40 on the plaster frame 20, two bar hangers 60 mounted at two sides of the plaster frame 20, and a housing 70 engageable with the plaster frame 20. The housing 70 and the transformer 40 are mounted at the left and right sides (with respect to FIG. 1) of the plaster frame 20, respectively.

The right side of the plaster frame 20 is provided with a cylindrical frame 23 which has a plurality of lugs 24 each having a hole aligned with an elongated hole 71 at a front end of the housing 70, so that the housing 70 can be fixedly mounted on the cylindrical frame 23 by a plurality of screws 72. A piece of heat-insulating fiber 74 and a piece of aluminum foil 75 are affixed to the backside of the housing 70 by a screw 73. As the junction box door 55 and the transformer 40 are mounted on the left side of the plaster frame 20 while the housing 70 is arranged on the right side of the plaster frame 20, the area of the plaster frame 20 can be reduced to 12"×7.75" which is much less than that (14"×13.5") of the conventional plaster frame. Hence, the recessed housing 10 according to the present invention is smaller than the conventional in size thereby reducing the material cost and facilitating the mounting operation. The enclosure 30 is composed of an enclosure 31 and a panel 32 which are joined together by screws. The enclosure 31 has a bottom 311 which is used as a heat sink for preventing the recessed housing from being overheated. The vertical edge of each of the enclosure 31 and the panel 32 has a protuberance 33 adapted to engage with the hole 201 of the plaster frame 20 (see FIG. 3).

Figure 3:
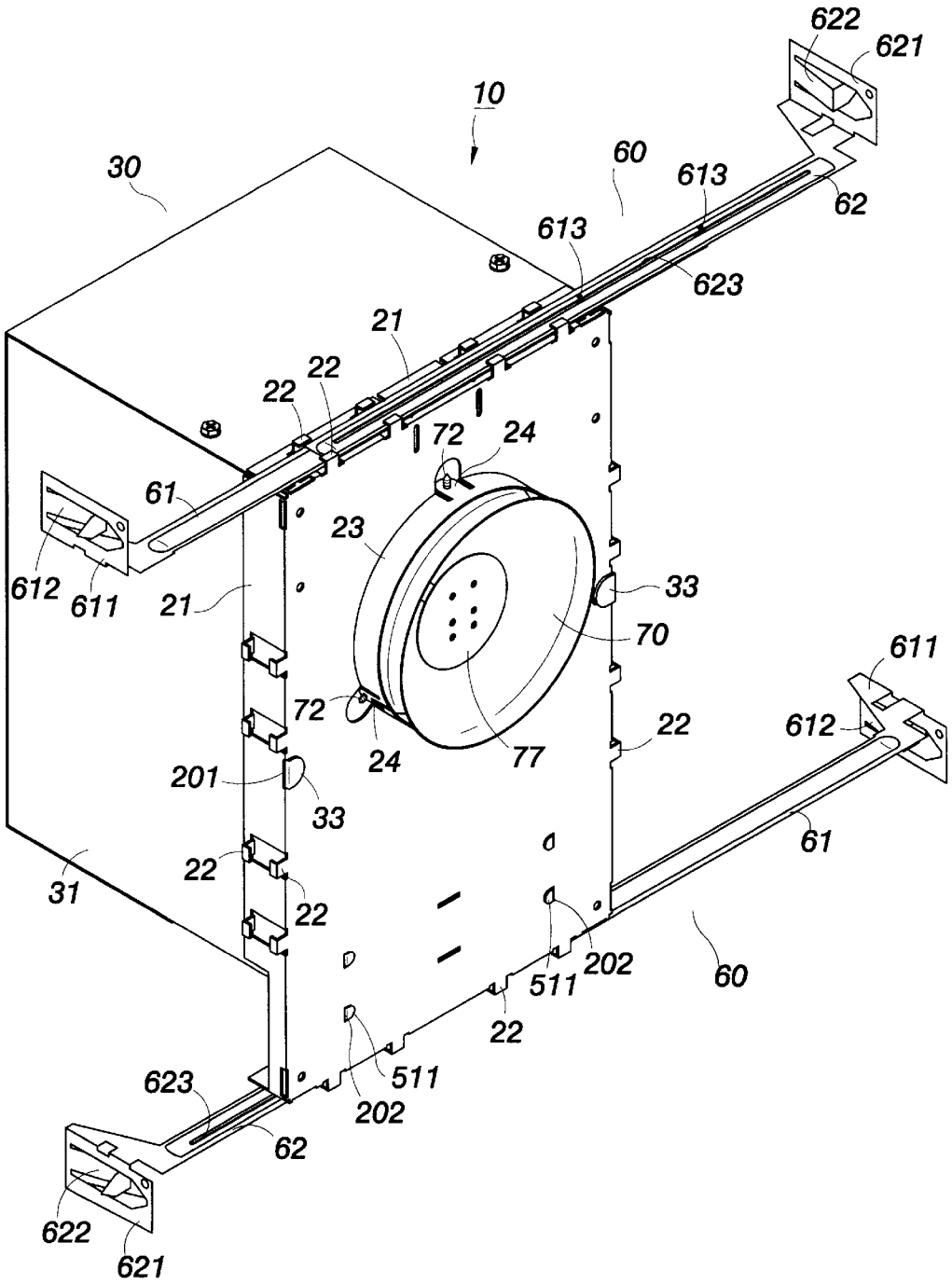
FIG. 3 is a perspective view of the present invention.

The junction box 50 includes a U-shaped frame 51, a bearing plate 52, a bottom plate 53, a clip 54 and two junction box doors 55 and 56. The enclosure 30 is composed of an enclosure 31 and a panel 32 which are joined together by screws. The bottom of the enclosure 31 is used as a heat sink. The vertical edge of each of the enclosure 31 and the panel 32 has a protuberance 33 adapted to engage with a hole 201 of the plaster frame 20, as shown in FIG. 3.

Figure 4:
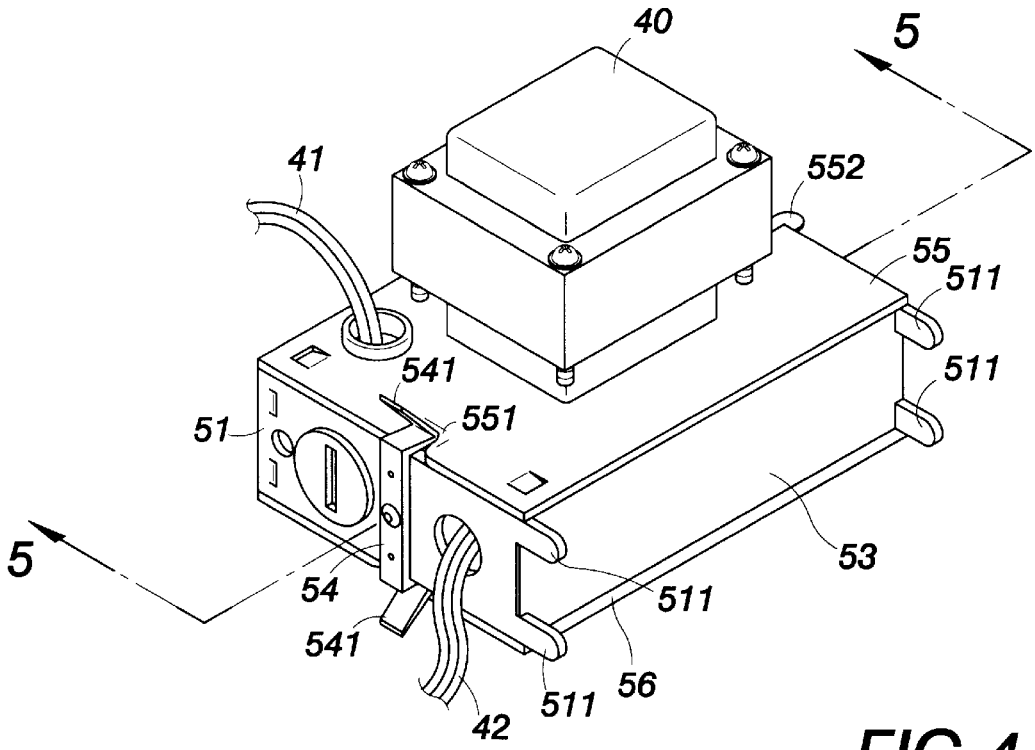
FIG. 4 illustrates the engagement between the transformer and the junction box door.
Figure 5:
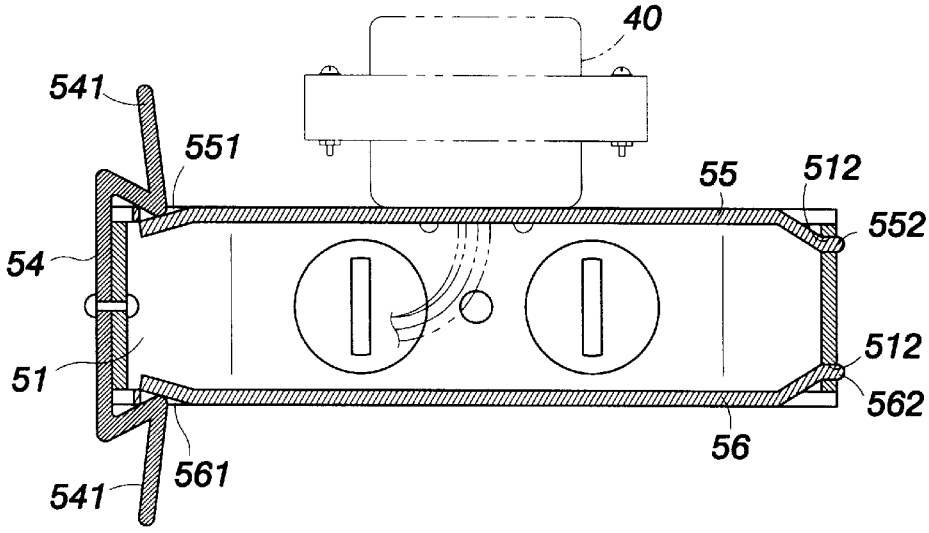
FIG. 5 is sectional view taken along line 5—5 of FIG. 4.
Figure 6:
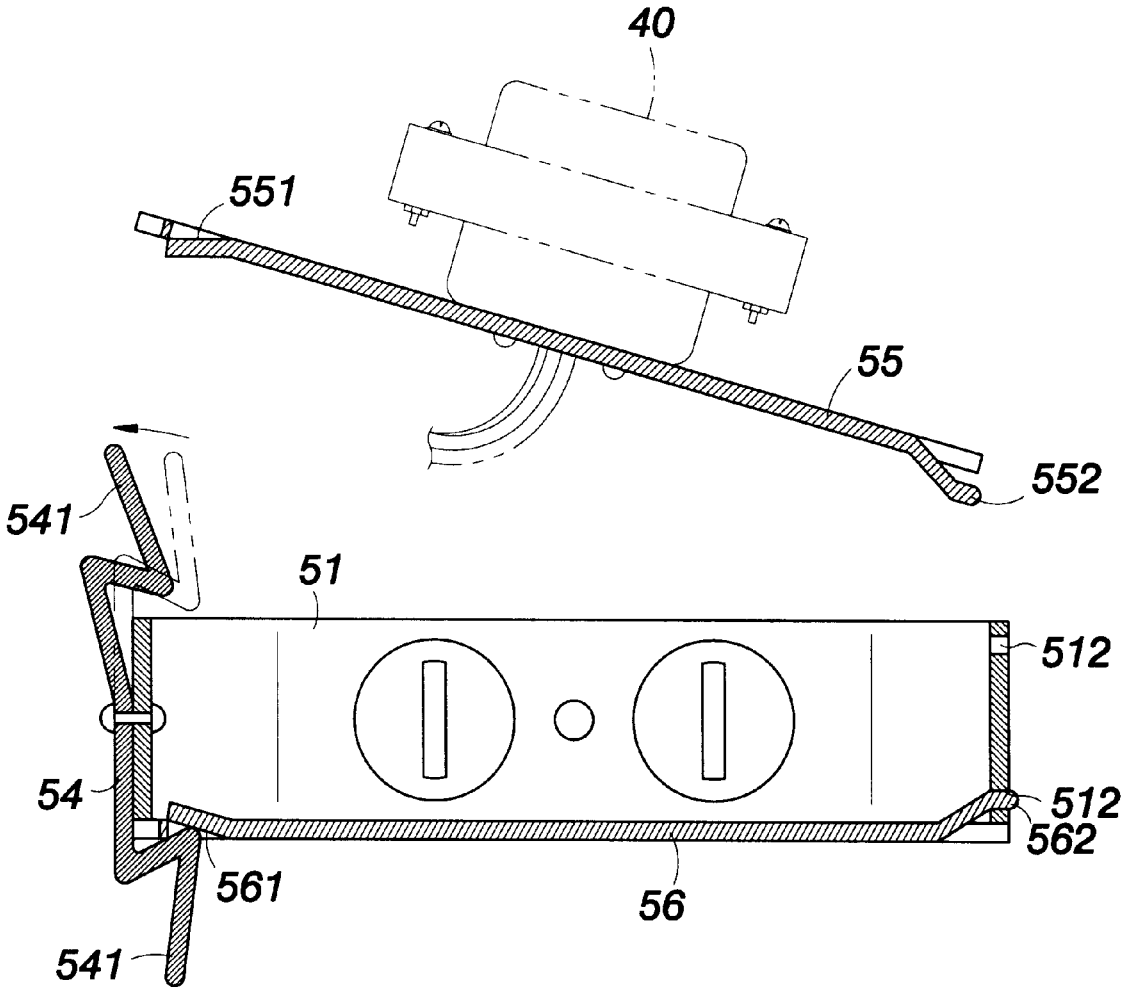
FIG. 6 illustrates how to remove the transformer together with the front cover from the junction box door.

The transformer 40 is fixedly mounted on the front junction box door 55 and provided with with electrical wires 41 and 42. The electrical wire 41 is composed of two sections and electrically connected with an electrical wire 76 of the housing 70, while the electrical wire 42 is connected to a power source (not shown). The electrical wire 76 is connected to an electrical socket 77 adapted to engage with a lamp. The U-shaped frame 51 has two legs each having two protuberances 511 which are fitted into respective holes 202 of the plaster frame 20. The bottom plate 53 is mounted on the two protuberances 511 of the U-shaped frame 51 so that when the U-shaped frame 51 is engaged with the plaster frame 20, the bottom plate 53 will be fixed in place. The bearing plate 52 is affixed to the U-shaped frame 51 by a screw 57. The front and back junction box doors 55 and 56 are of the same structure and have recesses 551 and 561 (see FIG. 4) at one end thereof and protruded lugs 552 and 562 at another end thereof. The clip 54 is riveted on one leg of the U-shaped frame 51 and provided with two V-shaped members 541 at two ends. When desired to fix the front and back junction box doors 55 and 56 on the U-shaped frame 51, the lugs 552 and 562 of the front and back junction box doors 55 and 56 are first inserted into holes 512 at two legs of the U-shaped frame 51 (see FIG. 5) and then the V-shaped member 541 of the clip 54 are engaged with the recesses 551 and 561. In case the transformer 40 does not work, it is only necessary to disengage the V-shaped member 541 of the clip 54 from the recess 551 (see FIG. 6) thereby enabling the front cover 55 together with the transformer 40 to be removed from the U-shaped frame 51 for maintenance. Similarly, the back cover 55 can be removed from the U-shaped frame 51 as required.

Figure 7:
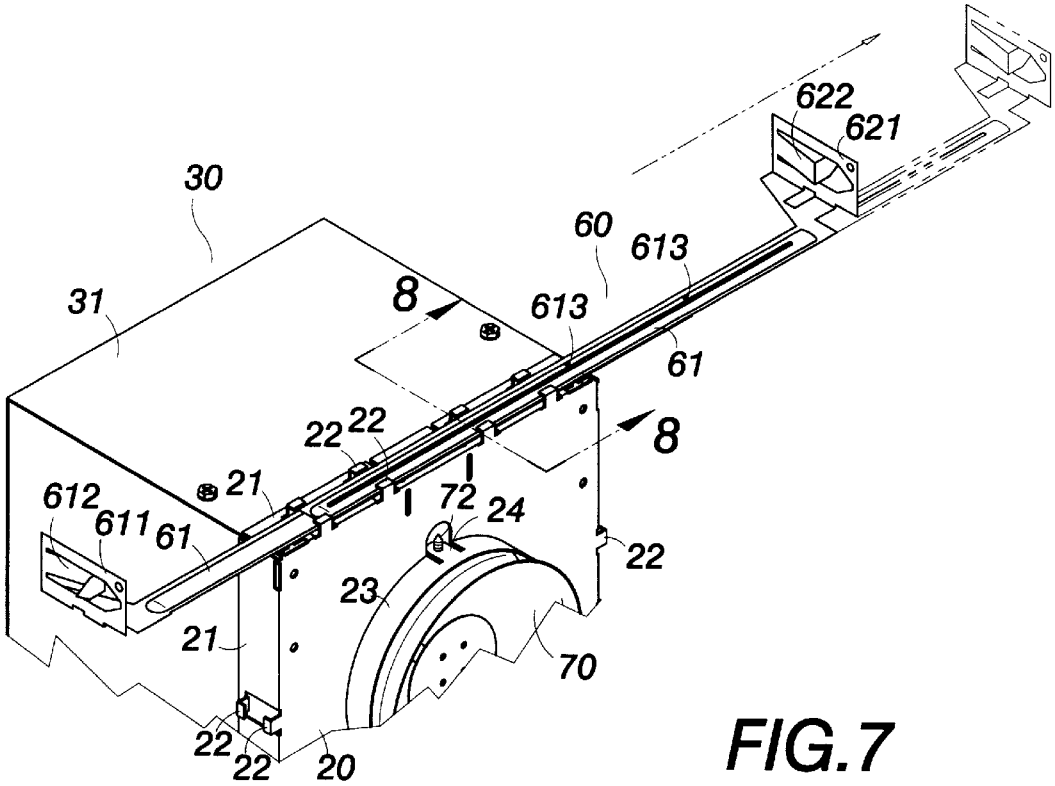
FIG. 7 illustrates the engagement between the bar hangers and the plaster frame.
Figure 8:
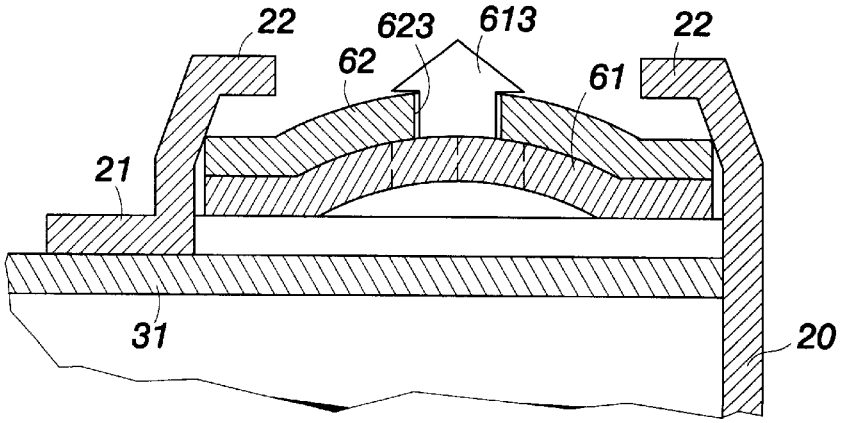
FIG. 8 is a sectional view taken along line 8—8 of FIG. 7.
Figure 9:
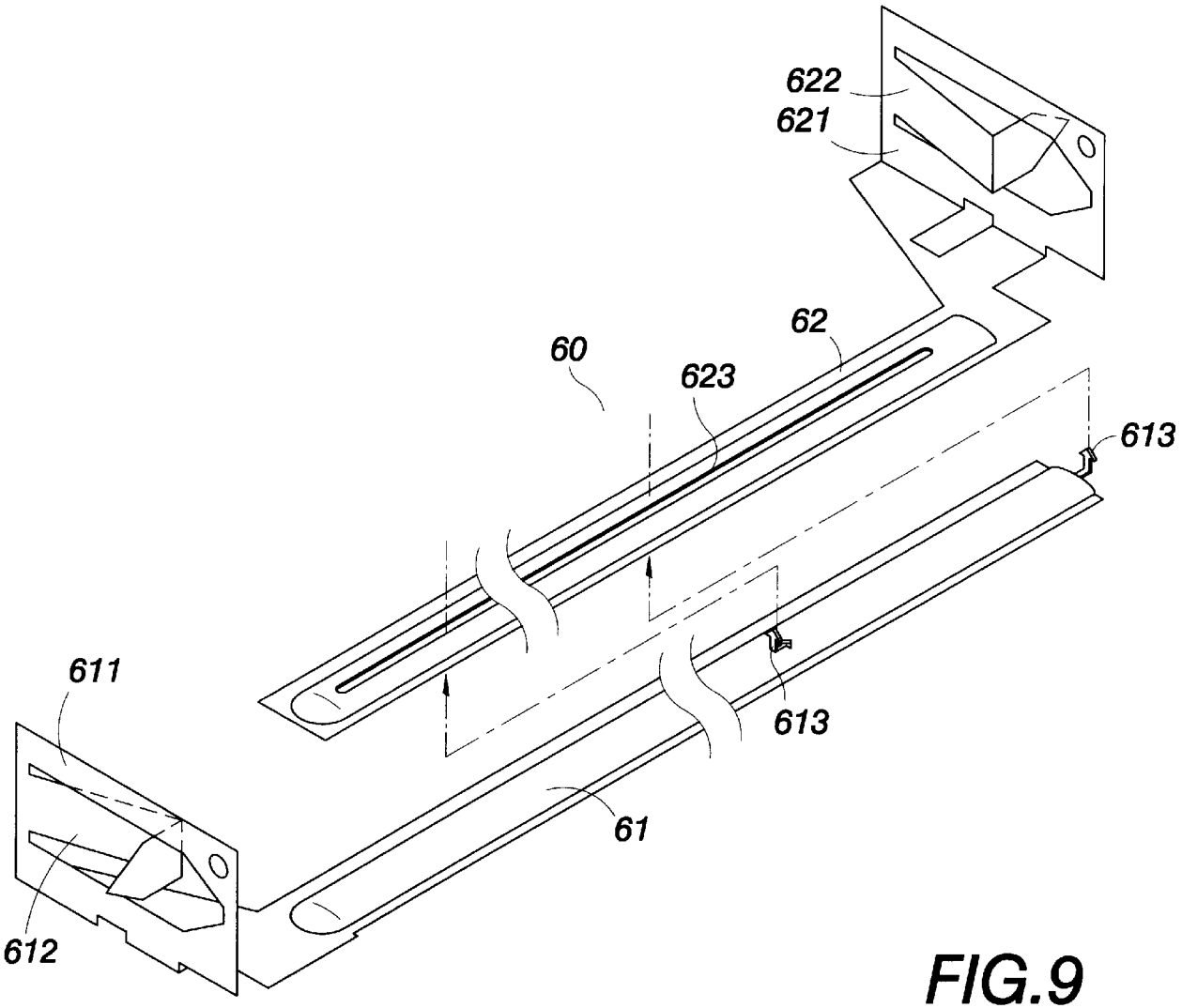
FIG. 9 is an exploded view of the bar hangers.

Referring to FIGS. 1 and 7, each edge 21 of the plaster frame 20 is provided with several pairs of inverted U-shaped hooks 22 configured to engage with a bar hanger 60, so that the recessed housing 10 can be suspended on a ceiling via the bar hanger 60. As shown in FIG. 9, the bar hanger 60 is composed of two rods 61 and 62 provided with upwardly extending ends 611 and 621 having hooks 612 and 622 configured to be engageable with a ceiling. The rod 61 is provided with a plurality of projections 613 having an enlarged head while the rod 62 is formed with an elongated slot 623 engaged with the projections 613 of the rod 61 so that the rods 61 and 62 can slide with respect to each other (see FIG. 8).

Figure 10:
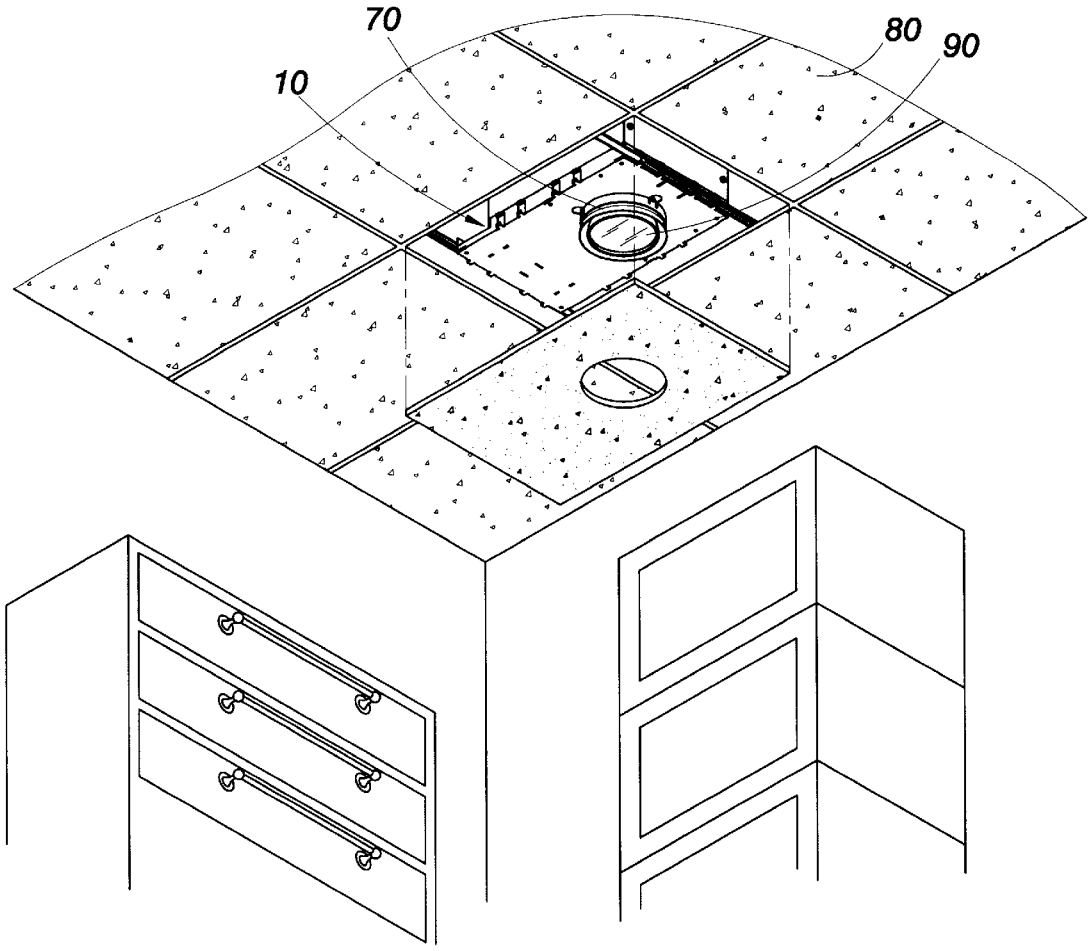
FIG. 10 illustrates how the present invention is mounted on the ceiling.

Looking now at FIG. 10, when desired to suspend the recessed housing 10 on the ceiling 80, the bar hangers 60 are first adjusted to hang on the ceiling 80 and then the lamp 90 is fitted into the housing 70. The lamp 90 is provided with spring means (not shown) for engaging with the housing 70. The spring means may be of any conventional design well known in the art and is not considered a part of the invention. When the transformer 40 does not work, it is only necessary to disengage the housing 70 from the cylindrical frame 23 of the plaster frame 20 and then disengage the clip 54 from the fixing frame 50 to remove the front junction box door 55 thereby enabling the transformer 40 to be removed with the front junction box door 55 for maintenance.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. An insulated ceiling type low voltage recessed housing comprising:

a rectangular plaster frame;

an enclosure mounted on said plaster frame and having one side provided with a cylindrical frame;

a housing fixedly fitted in said cylindrical frame;

a junction box mounted on another side of said enclosure and including a U-shaped frame having a first leg and a second leg, a first junction box door having a first end formed with a recess and a second end formed with a lug configured to be engageable with a hole of said first leg, a second junction box cover having a first end formed with a recess and a second end formed with a lug configured to be engageable with a hole of said first leg, and a clip riveted on said second leg and having V-shaped members at two ends configured to be engageable with said recesses;

a piece of heat-insulating fiber having one side affixed to a rear end of said housing;

a piece of aluminum foil mounted at another side of said heat-insulating fiber; and a transformer mounted on one of said junction box doors.

2. The insulated ceiling type low voltage recessed housing for halogen lamps as claimed in claim 1, wherein said rectangular plaster frame is provided with inverted U-shaped hooks configured to engage with a bar hanger, said bar hanger having a first rod and a second rod slidably connected with said first rod, each of said rods being provided with an upwardly extending end, said first rod having a plurality of projections each having an enlarged head, said second rod having an elongated slot configured to receive said projections.

* * * * *